US010753611B2

(12) United States Patent
Sedlov et al.

(10) Patent No.: US 10,753,611 B2
(45) Date of Patent: Aug. 25, 2020

(54) SYSTEM AND METHOD FOR IMPINGEMENT COOLING OF TURBINE SYSTEM COMPONENTS

(71) Applicant: GENERAL ELECTRIC TECHNOLOGY GMBH, Baden (CH)

(72) Inventors: Andrey Sedlov, Wurenlos (CH); Igor Baibuzenko, Moscow (RU); Vladimir Vassiliev, Turgi (CH)

(73) Assignee: GENERAL ELECTRIC CORPORATION GMBH, Baden (CH)

( * ) Notice: Subject to any disclaimer, the term of this patent is extended or adjusted under 35 U.S.C. 154(b) by 269 days.

(21) Appl. No.: 15/725,817

(22) Filed: Oct. 5, 2017

(65) Prior Publication Data

US 2018/0142892 A1 May 24, 2018

(30) Foreign Application Priority Data

Nov. 21, 2016 (RU) ..... 2016145441

(51) Int. Cl.
*F23R 3/04* (2006.01)
*F23R 3/00* (2006.01)
(Continued)

(52) U.S. Cl.
CPC ..... *F23R 3/002* (2013.01); *F23R 3/04* (2013.01); *F23R 3/06* (2013.01); *F23R 3/16* (2013.01);
(Continued)

(58) Field of Classification Search
CPC .... F23R 3/002; F23R 3/06; F23R 3/04; F23R 3/60; F23R 2900/03041; F23R 2900/03042; F23R 2900/03044
See application file for complete search history.

(56) References Cited

U.S. PATENT DOCUMENTS 3,652,187 A 3/1972 Loeffler et al.
4,622,821 A 11/1986 Madden
(Continued)

FOREIGN PATENT DOCUMENTS

EP 1323983 7/2003
GB 1578474 11/1980
(Continued)

OTHER PUBLICATIONS

Patent Search Report issued by the Russian Patent Office in corresponding RU Application No. 2016145441/06 dated Dec. 6, 2019.

*Primary Examiner* — Steven M Sutherland
(74) *Attorney, Agent, or Firm* — Grogan, Tuccillo & Vanderleeden, LLP

(57) ABSTRACT

A combustor includes a combustor shell, an inner liner disposed inside the combustor shell and having an inner surface defining a cavity configured to receive hot combustion gases from a combustion chamber of the combustor, and an outer surface, the combustor shell and the inner liner defining an annular flow channel therebetween, and a segment carrier operatively connected to the inner liner and operative to receive an upper portion of the inner liner, the segment carrier and the inner liner defining a purging cavity therebetween. The inner liner includes a plurality of impingement jet holes configured to direct a flow of cooling air from the annular flow channel to the purging cavity.

19 Claims, 7 Drawing Sheets

(51) Int. Cl.

| | |
|---|---|
| ***F23R 3/06*** | (2006.01) |
| ***F23R 3/16*** | (2006.01) |
| ***F23R 3/60*** | (2006.01) |

(52) U.S. Cl.
CPC ..... *F23R 3/60* (2013.01); *F23R 2900/00015* (2013.01); *F23R 2900/03044* (2013.01); *F23R 2900/03342* (2013.01)

(56) References Cited

U.S. PATENT DOCUMENTS

| | | | | |
|---|---|---|---|---|
| 4,820,097 | A | 4/1989 | Maeda et al. | |
| 5,012,645 | A | 5/1991 | Reynolds | |
| 5,291,732 | A * | 3/1994 | Halila | F23R 3/60 60/752 |
| 5,435,139 | A | 7/1995 | Pidcock et al. | |
| 6,711,900 | B1 * | 3/2004 | Patel | F23R 3/06 60/752 |
| 9,194,585 | B2 | 11/2015 | Cunha et al. | |
| 2006/0005543 | A1 * | 1/2006 | Burd | F23M 5/085 60/752 |
| 2009/0120094 | A1 | 5/2009 | Norster | |

FOREIGN PATENT DOCUMENTS

| | | |
|---|---|---|
| GB | 2049913 | 12/1980 |
| RU | 2150638 | 6/2000 |
| RU | 2173819 | 9/2001 |

* cited by examiner

SYSTEM AND METHOD FOR IMPINGEMENT COOLING OF TURBINE SYSTEM COMPONENTS

BACKGROUND

Technical Field

Embodiments of the invention relate generally to gas turbine systems and, more particularly, to a system and method for impingement cooling components of a combustor of a gas turbine system.

Discussion of Art

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail or degrade, such as a result of thermal-mechanical fatigue and/or oxidation. Since higher temperature flows generally result in increased performance, efficiency, and power output of the gas turbine system, the components that are subjected to high temperature flows must be cooled to allow the gas turbine system to operate at increased temperatures. In modern combustors, high flame temperatures drive a need to actively cool virtually all metal surfaces of the combustor.

With existing gas turbine systems, for example, air for the combustion process is supplied through an annular channel between a hot part of the combustor, namely, the inner liner, and the shell of the combustor. Subsequent to combustion, hot gases flow from the combustor to the turbine in a direction generally opposite the compressed air flow through the annular channel. The upper part of the hot gas passage of the combustor is known as the segmented zone, which includes a plurality of segments attached to a segment carrier, while the lower part of the hot gas passage is referred to as the inner liner of the combustor. The tip of the inner liner defines a ring that is received inside a lower region of the segment carrier. The cavity between the conical part of the inner liner and the segment carrier is called a purging cavity, and is typically filled with a mixture of hot gases and cooling air provided by purging and leakage flows. To protect the segment carrier to direct exposure to high temperatures, a retaining ring may be utilized.

Typically, the outer surface of the retaining ring is purged by the cooling air directed from the segment carrier. However, testing has shown insufficient local cooling efficiency, resulting from the deterioration of the highly swirled and non-uniform hot gas flow, coupled with thermal deformation of the retaining ring, which can lead to closure of the purging area. In some areas, due to the high pressure of the hot gas flow, hot gas injection into the purging cavity can occur, which can cause local overheating of the retaining ring. These hot spots can lead to increased oxidation and reduced lifetime of the retaining ring. In addition to the retaining ring, various components of the turbine, including of the combustor, more generally, may be susceptible to temperature rise due to direct contact with hot gas flow from the combustion chamber.

In view of the above, there is a need for an improved cooling system for the components of a combustor and, more particularly, for a retaining ring of the combustor, that ensures effective and robust cooling to prevent overheating, and which is insensitive to the characteristics and parameters of the hot gas flow.

BRIEF DESCRIPTION

In an embodiment, a combustor is provided. The combustor includes a combustor shell defining an outer liner, an inner liner disposed inside the combustor shell and having an inner surface configured to receive hot combustion gases from a combustion chamber of the combustor, and an outer surface, the combustor shell and the inner liner defining an annular flow channel therebetween, and a segment carrier operatively connected to the inner liner and operative to receive an upper portion of the inner liner, the segment carrier and the inner liner defining a purging cavity therebetween. The inner liner includes a plurality of impingement jet holes configured to direct a flow of cooling air from the annular flow channel to the purging cavity.

In another embodiment, a gas turbine system is provided. The gas turbine system includes a compressor and a combustor downstream from the compressor. The combustor includes a combustor shell, and an inner liner disposed inside the combustor shell and having an inner surface configured to receive hot combustion gases from a combustion chamber of the combustor, and an outer surface. The combustor shell and the inner liner define an annular flow channel therebetween. The combustor further includes a segment carrier arranged generally above the inner liner and receiving an upper portion of the inner liner, the segment carrier and the inner liner defining a purging cavity therebetween, and a plurality of impingement jet holes formed in the inner liner and providing a flow passage between the annular flow channel and the purging cavity. The compressor is configured to supply compressed air to the annular flow channel. A first portion of the compressed air is used by the combustor for combustion, producing the hot combustion gases, and a second portion of the compressed air is directed through the impingement jet holes to the purging cavity to purge the purging cavity of the hot combustion gases.

In yet another embodiment, a method of cooling a component in a gas turbine system is provided. The method includes the steps of passing compressed air into an annular channel defined between an outer surface of an inner liner of a combustor of a gas turbine system and one of a middle liner and an outer shell of the combustor, the inner liner being configured to receive a flow of hot combustion gas from a combustion zone of the combustor therethrough, and passing a portion of the compressed air in the annular channel through a plurality of impingement jet holes in the inner liner such that the compressed air impinges on a component exposed to the flow of hot combustion gas to provide for impingement cooling of the component.

DRAWINGS

The present invention will be better understood from reading the following description of non-limiting embodiments, with reference to the attached drawings, wherein below:

DETAILED DESCRIPTION

Figure 1:
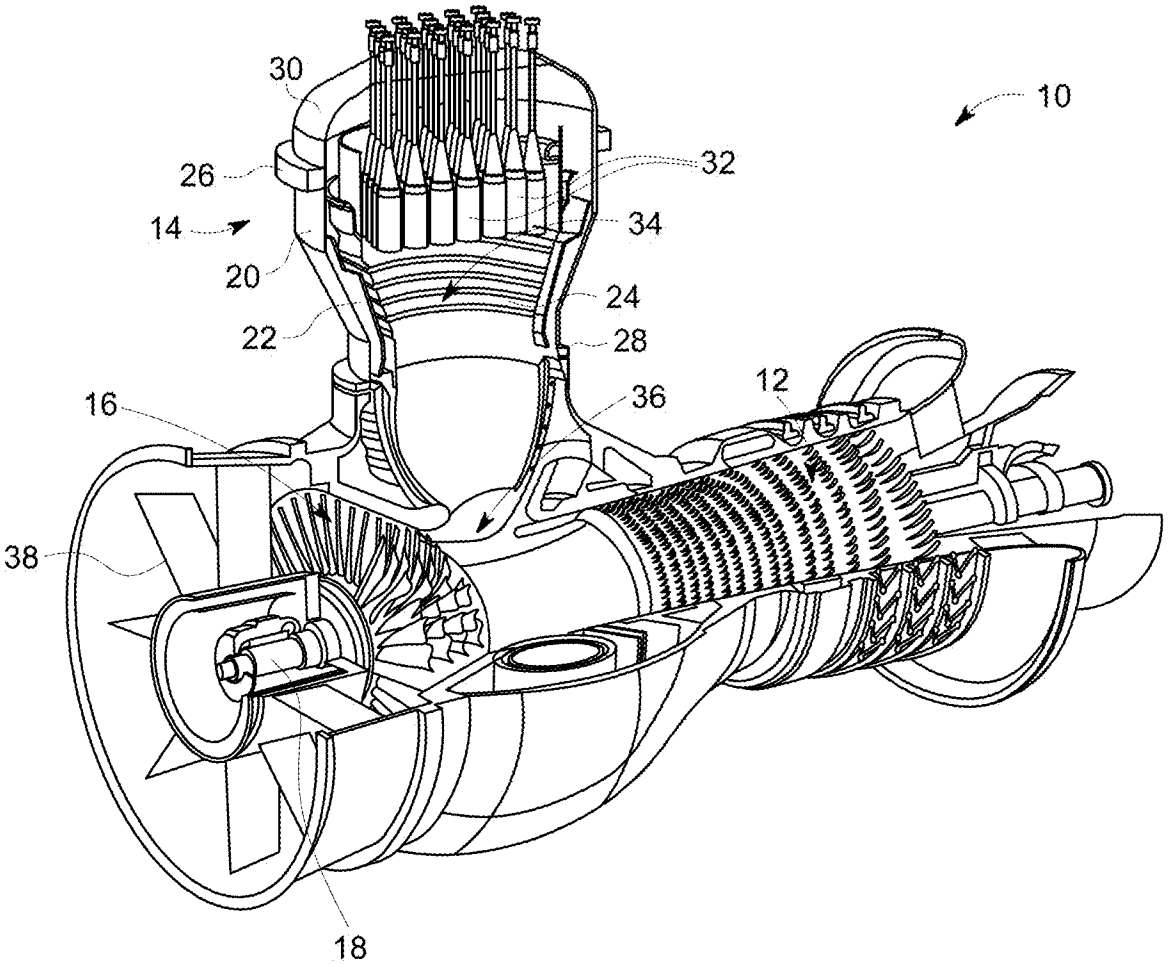
FIG. 1 is a schematic illustration of a gas turbine system, according to an embodiment of the invention.

Reference will be made below in detail to exemplary embodiments of the invention, examples of which are illustrated in the accompanying drawings. Wherever possible, the same reference characters used throughout the drawings refer to the same or like parts. While embodiments of the invention are suitable for use in connection with cooling (or minimizing the temperature increase of) a retaining ring of a silo-type combustor of a gas turbine system utilizing impingement jets, embodiments of the invention are also applicable to cooling other components of a combustor of a gas turbine system that may be exposed to hot combustion gases. In yet other embodiments, the invention may be utilized to cool components of a gas turbine system, generally.

As used herein, "operatively coupled" refers to a connection, which may be direct or indirect. The connection is not necessarily a mechanical attachment. As used herein, "fluidly coupled" or "fluid communication" refers to an arrangement of two or more features such that the features are connected in such a way as to permit the flow of fluid between the features and permits fluid transfer.

Embodiments of the invention relate to a system and method for cooling components of a combustor of a gas turbine system and, more specifically, the retaining ring of the combustor of a gas turbine system. The system and method provides effective and robust cooling of the retaining ring, insensitive to the flow characteristics of the hot combustion gas stream. The system and method utilize impingement jets that provide highly effective, direct cooling of the retaining ring, and which purge hot gases from the area surrounding the retaining ring, thus preventing the injection of hot combustion gases into such area.

Referring to FIG. 1, an exemplary gas turbine system 10 (also referred to herein, more generally, as gas turbine 10) within which the system of the invention may be incorporated, is illustrated. The gas turbine 10 includes a compressor 12 that takes in air through an air inlet. The compressor 12 then forces air under pressure into a combustion chamber, shown in FIG. 1 as a silo-type combustor 14 that is top-mounted to the turbine external to the turbine body. In an embodiment, the compressor 12 may be a multi-stage axial compressor (e.g., a 14-stage axial compressor, as shown in FIG. 1) having a plurality of rotating and stationary airfoils in an alternating pattern. The combustor 14 provides combustion gases to turbine 16 which rotates shaft 18, rotating the compressor blades in compressor 12 and the output shaft 18 which provides rotational energy to an electrical generator (not shown) which is attached to the output shaft 18.

As further shown in FIG. 1, the combustor 14 includes an outer cylindrical wall 20, a middle liner 22, and a ribbed inner combustion liner 24. The outer walls 20 of the combustor 14 are joined by flanges 26, 28. The combustor 14 further includes a cap 30 which is bolted to flange 26. In operation, discharge air from the compressor 12, which is used within the combustor 14 during the combustion process, exits the compressor 12 and travels upwardly along the combustor between the inner liner 24 and the middle liner 22, and between the middle liner 22 and the outer cylindrical wall 20. The high pressure compressor air then reverses direction at the cap 30 where the air passes through a number of premix burners 32 where it is mixed with fuel. Combustion occurs within a downstream combustion chamber 34. Hot gases then exit the combustor 14 through area 36. These hot combustion gases travel into the turbine 16 where they turn the rotor which is connected to the shaft 18 used to generate power. The hot gases, after passing through the turbine, are exhausted through area 38.

Figure 2:
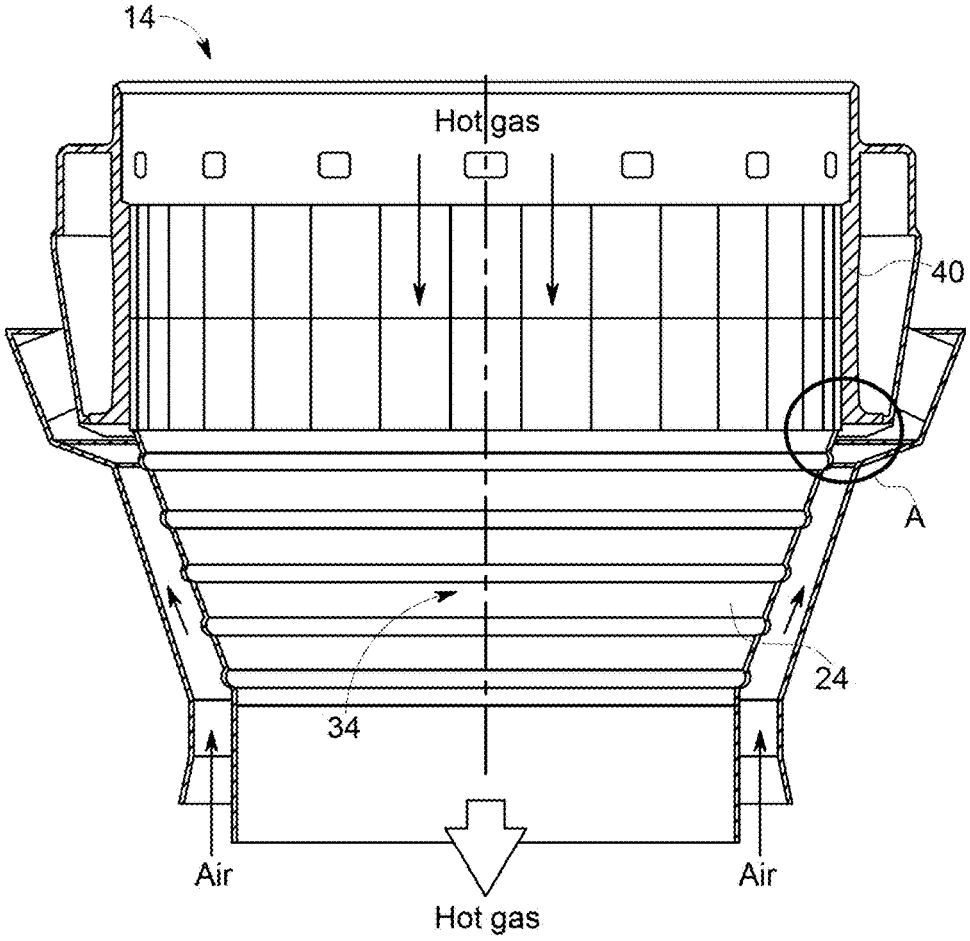
FIG. 2 is a cross-sectional illustration of the combustor of the gas turbine system of FIG. 1.

Turning now to FIG. 2, a detailed, cross-sectional illustration of the silo-combustor 14 is shown. As shown therein, and as described above, compressed air from the compressor 12 is permitted to flow upwards through the combustor 14 along the outer surface of the inner liner 24 (through an annular channel defined by the outer surface of the inner liner 24 and an inner surface of a middle liner 22 or outer wall 20), as indicated by the arrows. At the top of the combustor 14, the compressed air enters the burners 32 where it is mixed with fuel and then combusted in the combustion chamber 34. Relative to hot combustion gases, the compressed air that flows upwards into the combustor 14 on the outside of the inner liner 24, is cool. Combustion within chamber 34 produces hot gases that then flow downwardly (in a direction substantially opposite the cool supply air) interior to the inner liner 24.

The inner, central area of the combustor 14 downstream from the burners 32 is referred to as the hot gas passage of the combustor 14. The upper part of the hot gas passage of the combustor 14 is known as the segmented zone, which includes a plurality of segments 42 attached to a segment carrier 40, while the lower part of the hot gas passage is referred to as the inner liner 24 of the combustor 14. The segment carrier 40 is a substantially annular, structural part designed to carry on an inner periphery thereof the plurality of rectangular segments 42. The plurality of segments 42 are configured to protect and shield the segment carrier 40 from the hot combustion gases within the hot gas passage as they exit through the inner liner 24. In an embodiment, the inner liner 24 includes a generally conical portion 46 that terminates in a tip 44 defining a ring. The inner liner 24 is configured to drive the flow of hot gases out of the combustion chamber 34 and into the transition piece 36 that leads to the turbine 16, as discussed in detail hereinafter.

Figure 3:
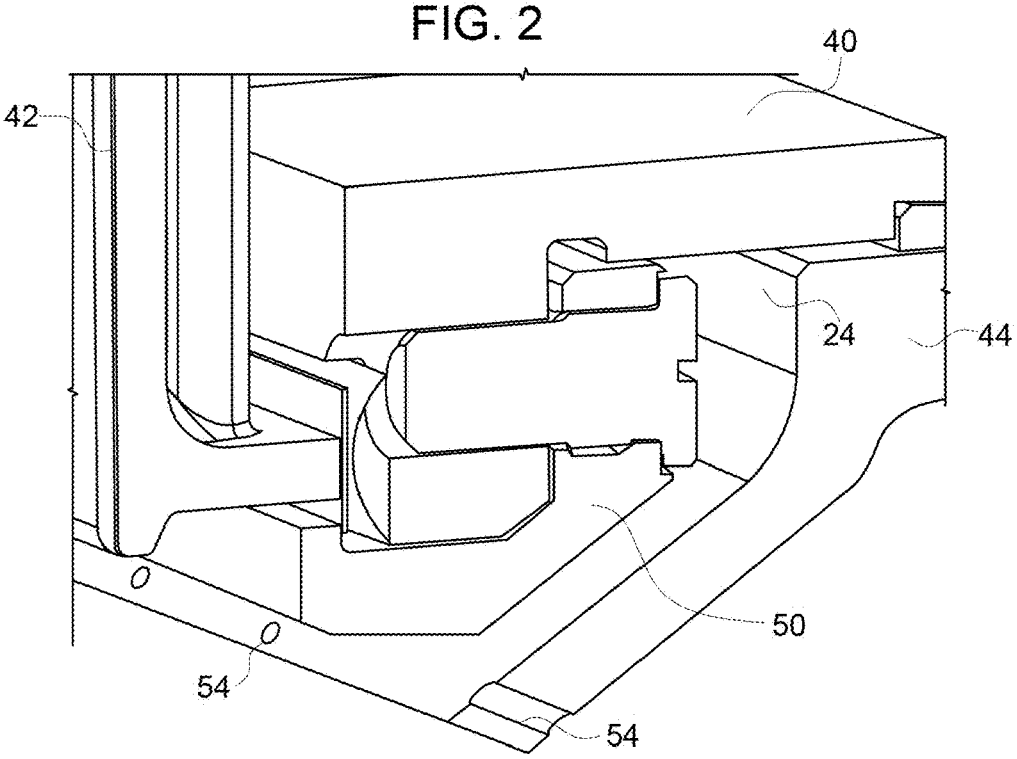
FIG. 3 is a perspective view of area A of FIG. 2.
Figure 4:
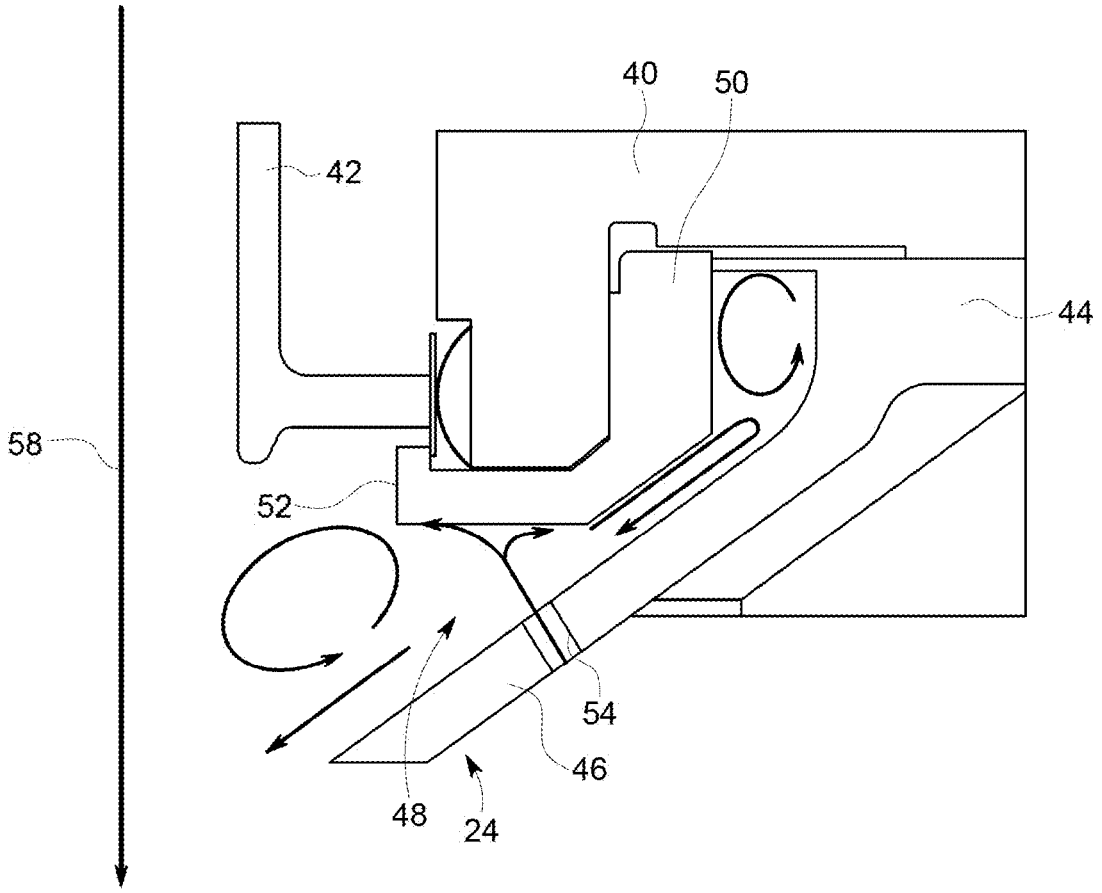
FIG. 4 is a cross-sectional view of area A of FIG. 2, illustrating the cooling air flow within the cavity.

Turning now to FIGS. 3 and 4, the interrelationship between the inner liner 24 and the segment carrier 40 is shown. As illustrated therein, the tip 44 of the inner liner 24 (defining the ring) is received inside a lower region of the segment carrier 40. The conical portion 46 of the inner liner 24 and the segment carrier 40 define therebetween a cavity 48, referred to as a purging cavity. Typically, hot combustion gases flowing through the hot gas passage of the combustor 14 are permitted to enter the purging cavity 48. As further illustrated in FIGS. 3 and 4, a retaining ring 50 may be utilized to protect the lower portion of the segment carrier 40 from direct exposure to high temperatures (from the hot combustion gases). In addition, the retaining ring 50 may carry a sealing device or sealing system between the segments 42 and the segment carrier 40. Mounting pins or similar fasteners may be utilized to mount the retaining ring 50 to the segment carrier 40.

With further reference to FIGS. 3 and 4, in certain embodiments, and as typically is the case, the outer surface of the retaining ring 50 may be purged by cooling air directed from the segment carrier through cooling apertures. The cooling air may be bleed air from the supply of compressed air traveling upwards though the combustor 14 prior to reaching the burners 32. As indicated above, testing has demonstrated that cooling of the retaining ring utilizing standard cooling apertures in the segment carrier 40 may not be sufficient to prevent overheating and oxidation of the retaining ring 50. In particular, it has been discovered that cooling air from the apertures may not be capable of purging the purging cavity 46 at all circumferential locations due to non-uniformity of the pressure in the hot gas flow, which may result in hot gas injection into the purging cavity 48. This incursion of hot gases can lead to localized hot spots on the retaining ring 50, ultimately resulting in shorter component lifetime. Hot gas exposed surfaces 52 (exposed to the hot gas in the hot gas passageway) are illustrated in FIG. 3.

As shown in FIGS. 3 and 4, in order to mitigate or eliminate localized hot spots and overheating of the retaining ring 50 due to incursion of hot gases into the purging cavity 48, the system of the invention utilizes a plurality of impingement jet holes or apertures 54 formed in the conical portion 46 of the inner liner 24. As shown therein, these impingement jet holes 54 extend through the conical portion 46 of the inner liner 24 and are configured to direct cooling air from the compressed air flow between the inner liner 24 and the middle liner 22 (or outer liner 20) so that it directly impinges upon the retaining ring 50, thereby cooling the retaining ring 50. In particular, the impingement jet holes 54 form high momentum jets of cooling air which pass through the hot gas flow in the purging cavity 48 and effectively cool down the retaining ring 50.

Figure 5:
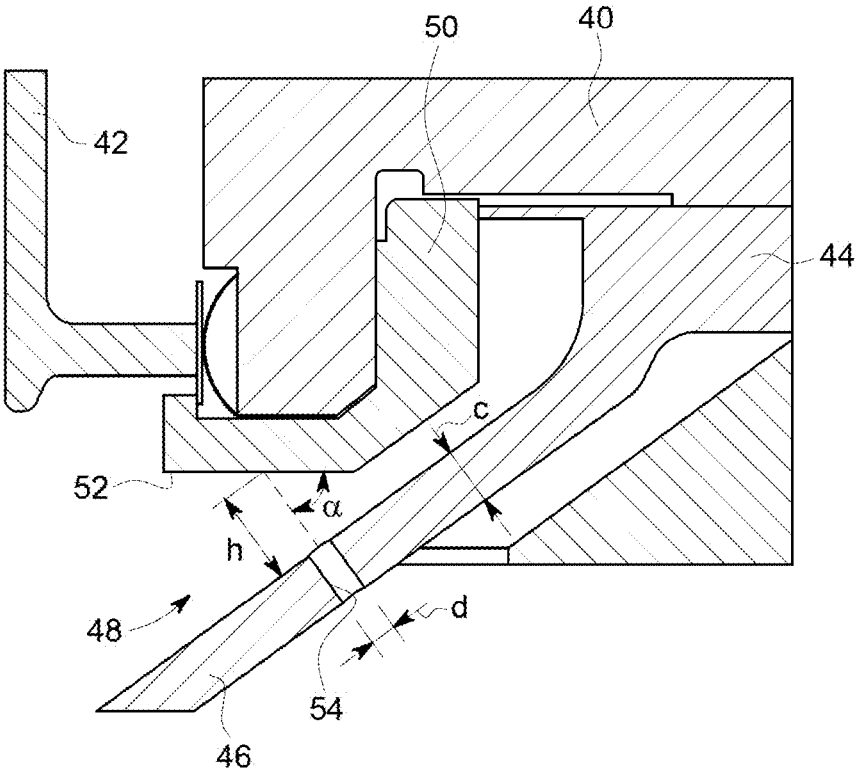
FIG. 5 is another cross-sectional view of area A of FIG. 2.
Figure 6:
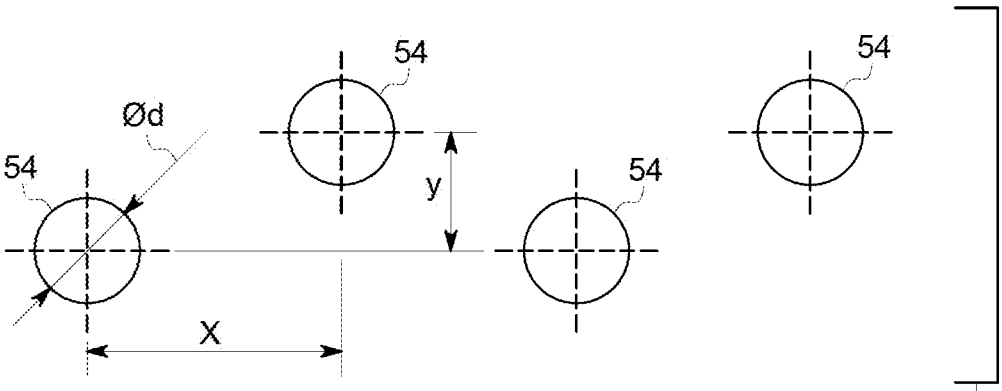
FIG. 6 is a simplified illustration of impingement jet holes in the combustor.

In an embodiment, the impingement jet holes 54 are formed in the inner liner 24 and are evenly distributed over the entire circumference of the inner liner 24. With reference to FIGS. 5 and 6, in an embodiment, the impingement jet holes have a diameter, d, which is governed by the equation $d=4S/P$, where S is the area of the impingement cooling hole 54 and P is the circumference of the hole. In an embodiment, $d=0.15-1.0h$, where h is the distance between the outlet of the hole 54 and the contact portion of the retaining ring, as shown in FIG. 5. In an embodiment, the thickness of the retaining ring, c, is equal to approximately 0.5–5d. In an embodiment, with reference to FIG. 6, $x=1-10d$ and $y=0.25-2.5d$, where x and y are pitches at a plane normal to impingement jet direction. In an embodiment, the impingement jet holes are oriented to direct a flow of cooling air at an angle, $\alpha$, with the retaining ring 50, as illustrated in FIG. 4. In an embodiment, a is between approximately 30-150 degrees.

In some embodiments, the impingement jet holes 54 are located approximately every 1° to 2.6° throughout the circumference of the inner liner 24 and, more particularly, approximately every 1.2° to 2.4°. In other embodiments, the impingement jet holes 54 are formed in the inner liner 24 approximately every 1.4° to 2.2° and, more particularly, approximately every 1.6° to 2.0°, and even more particularly about every 1.8° throughout the circumference. In an embodiment, the impingement jet holes 54 are between approximately 0.2 inches and 0.4 inches in diameter. In yet other embodiments, the impingement jet holes 54 may be of any shape and size, including cylindrical rectangular, conical and the like, and may be located at any radial position or spacing so long as the jets impinge upon the surface of the retaining ring 50. In particular, it is contemplated that the impingement jet holes may have any hole count, shape, size, pattern, and radial as well as circumferential arrangement, as long as the impingement on the hot gas exposed surface is achieved. In an embodiment, the impingement jet holes 54 are arranged so as to impinge upon a middle of a surface or component to be cooled.

In an embodiment, the impingement jet holes 54 may be utilized to cool combustor components, such as a retaining ring, of various gas turbines such as, for example, a GT11N2 EV—B-class engine, a GT13E2—E-class engine, and GT24 and GT26—F-class engines, although the invention is certainly not limited in this regard. In an embodiment, there may be 200 impingement jet holes 54 located every 1.8° about the conical portion 46 of the inner liner 24.

While the inner liner 24 may be manufactured initially with the impingement jet holes 54 for integration with a combustor, the invention is not so limited in this regard. In particular, it is contemplated that existing combustors may be retrofit or modified to provide impingement jet cooling. For example, the impingement jet holes 54 may be drilled in the inner liner 24 per the specifications indicated above in the field or on site.

Figure 7:
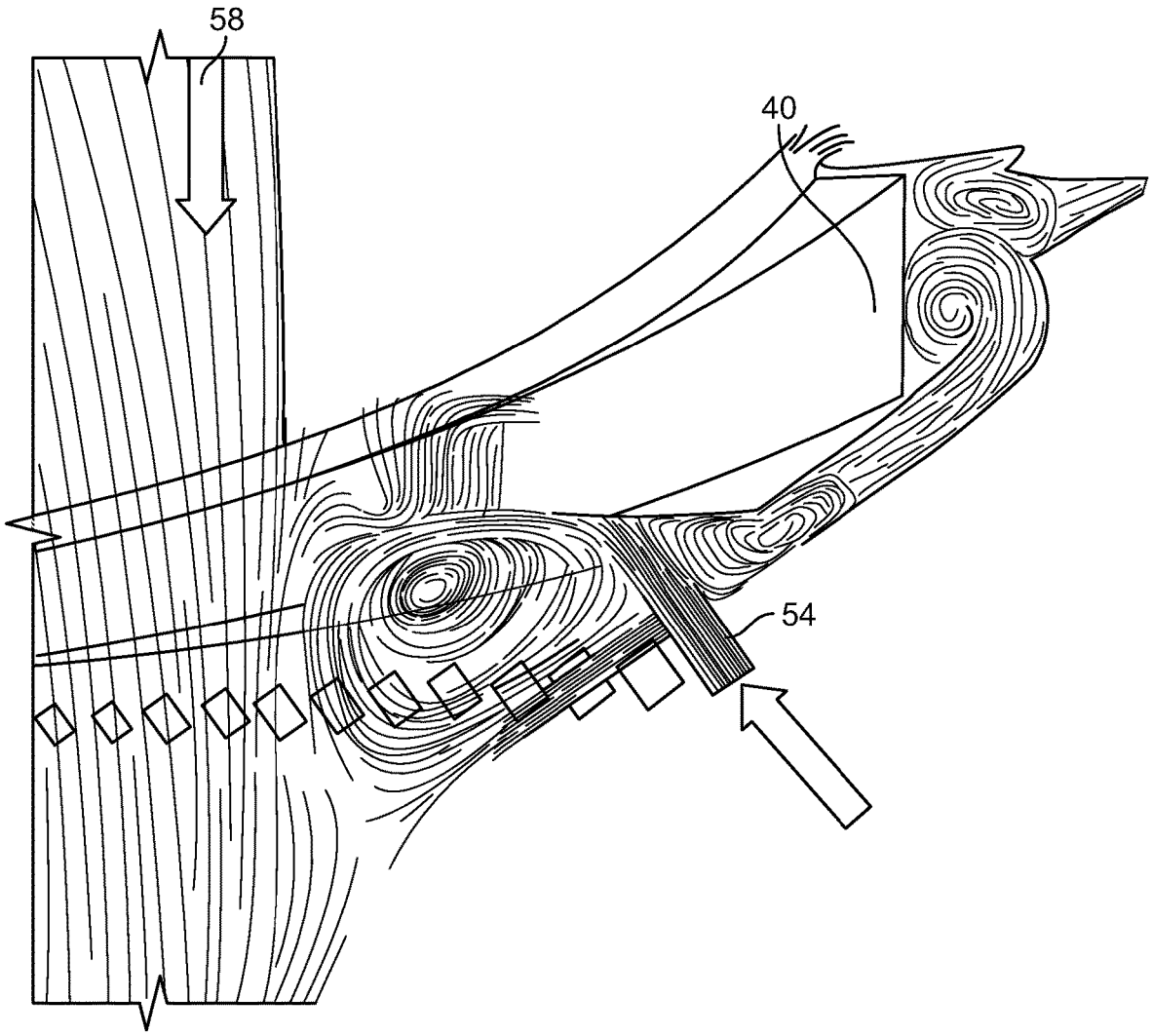
FIG. 7 is a perspective, cross-sectional view of a portion of the combustor, showing the cooling air flow provided by impingement jets.

With specific reference to FIGS. 4 and 7, the effect of the injection of cooling air through the impingement jet holes 54 on air flow in the purging cavity 48 is illustrated. As shown therein, cooling air that is injected through the impingement jet holes 54 impinges directly upon the retaining ring 50, providing for direct cooling of the retaining ring 50. The cooling air injected into the purging cavity 48 through the impingement jet holes 54 also functions to purge the purging cavity 48 of hot gases and generally prevent or mitigate the hot gas flow 58 from entering the purging cavity 48 and heating the retaining ring 50. In particular, the impingement jets of cooling air provide a pressurized flow out of the purging cavity 48, keeping the hot gases away from the retaining ring 50, as well as a pressurized flow upwards (and into the purging cavity 48) along the outer surface of the retaining ring 50, cooling the retaining ring 50.

Figure 8:
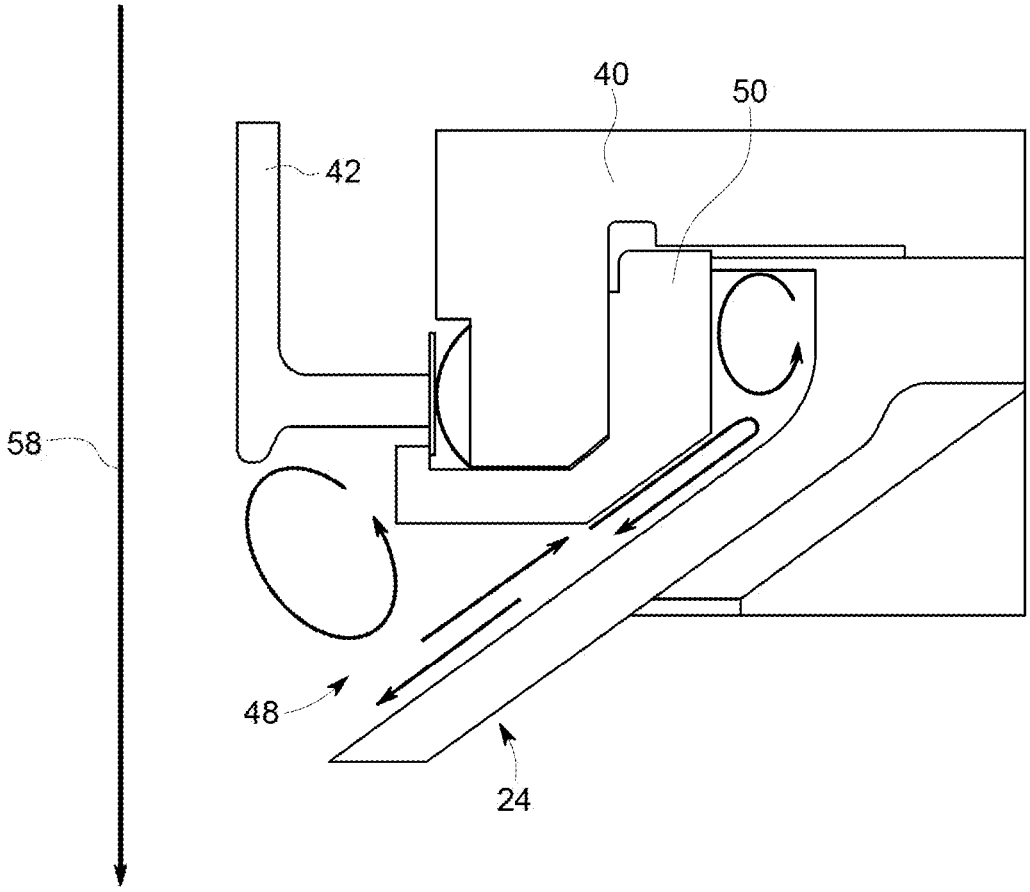
FIG. 8 PRIOR ART
FIG. 8 is a cross-sectional illustration showing hot gas flow into the purging cavity of a prior art combustor.

This is in contrast to traditional arrangements that utilize only side-facing secondary airflow for cooling. In particular, as illustrated in FIG. 8, prior art configurations permit hot gas from the hot gas flow 58 to enter the purging cavity 48 and heat the retaining ring 50, there being no effective cooling air flow to counter the hot gas flow into the purging cavity 48.

The system and method of the invention therefore provides effective and robust impingement cooling of the retaining ring 50, insensitive to the flow characteristics of the hot combustion gas stream 58. In particular, the impingement jets 54 provide highly effective, direct cooling of the retaining ring, and also function to purge hot gases from the purging cavity 48, thus preventing the injection of hot combustion gases into the purging cavity 48. The invention therefore provides for effective cooling of the retaining ring, by the impingement jets, released from the inner liner through the hot gas flow which significantly extends the lifetime of the retaining ring. In particular, it has been demonstrated that low cycle fatigue resistance may be increased by approximately 50 times as compared to existing systems. In connection with increased lifetime, maintenance intervals may also be extended.

Moreover, as a result of lower temperatures within the purging cavity 48 due to the impingement and purging cooling provided by the impingement jets, high cost, specialized materials necessary to withstand typical high operating temperatures within the combustor can be replaced with lower cost materials that are suitable for use at lower temperatures. For example, the cooling provided by the impingement jets of the invention allow for the retaining ring to be manufactured from lower cost steel rather than more costly Nickel-based materials. Accordingly, material costs for the retaining ring may be reduced by at least 40-50%.

While the system and method discussed above contemplates impingement cooling of the retaining ring and cooling of the purging cavity utilizing impingement jets in the conical portion of the inner liner of the combustor, the invention is not so limited in this regard. In particular, it is contemplated that impingement jets may be utilized to cool or purge other components and areas within the combustor (including silo-type or other combustor types), as well as turbine components, more generally.

Figure 9:
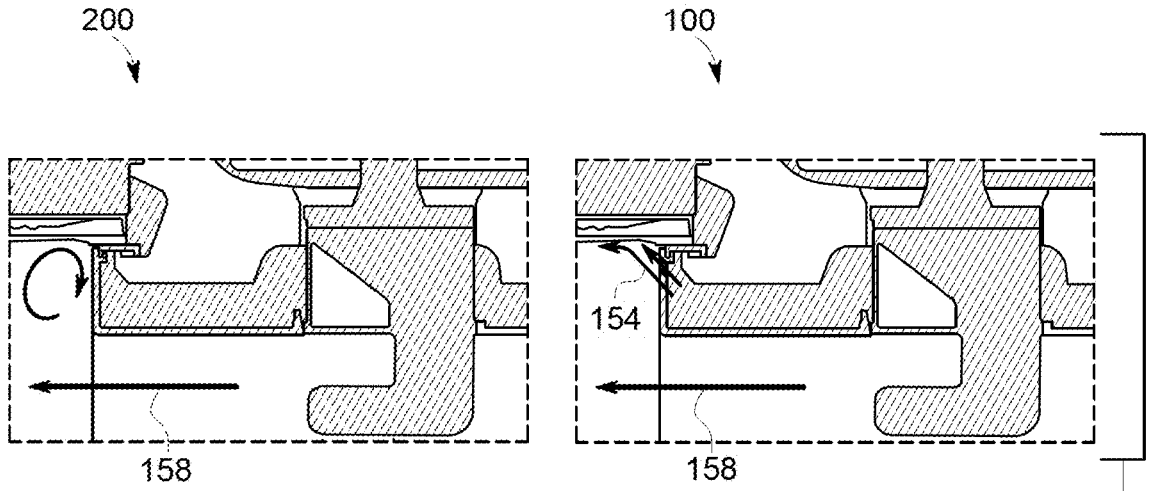
FIG. 9 is a schematic illustration of an impingement cooling system, according to another embodiment of the invention.

For example, FIG. 9 illustrates the use of impingement jets 154 to providing cooling for the nozzle to combustor interface 100 of another gas turbine (e.g., a GE13E2—E-class engine). Air flow through the jets 154 is shown at 100 to prevent the incursion of hot gas flow 158 upon the nozzle to combustor interface. This is in contrast to the typical buildup of hot gases at the interface which can occur in the absence of such impingement jets, as shown at 200.

Figure 10:
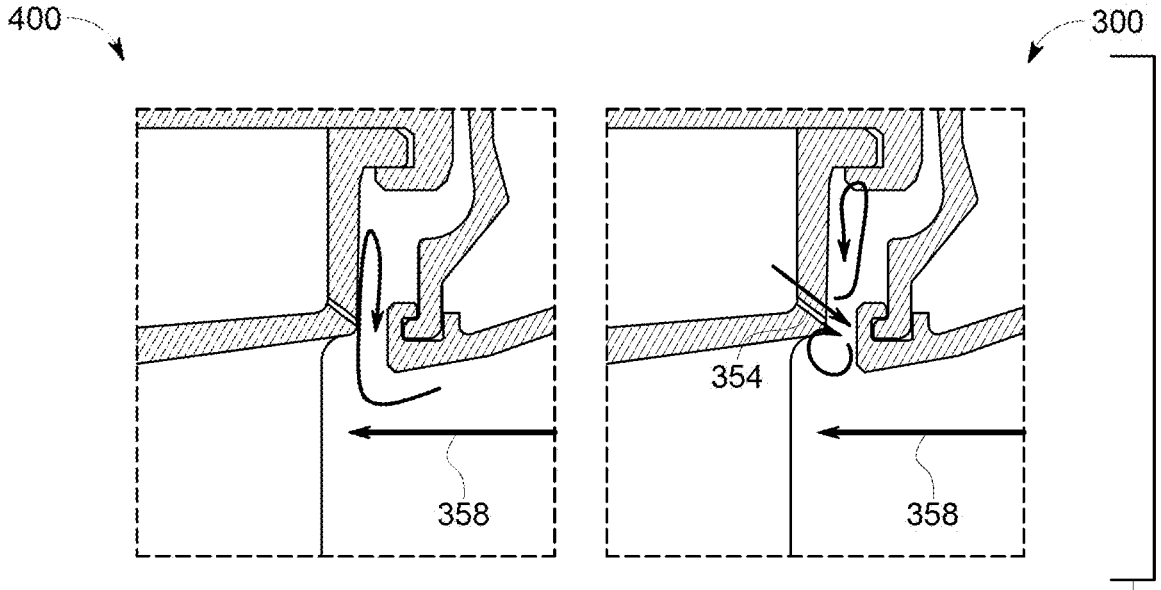
FIG. 10 is a schematic illustration of an impingement cooling system, according to yet another embodiment of the invention.

Similarly, FIG. 10 illustrates the use of impingement jets 354 to provide cooling for the secondary combustor liner 300 of a gas turbine (such as a GT26 or GT24—F-class engine). Air flow through the jets 354 is shown at 300 to provide impingement cooling, as well as purging of hot gases from the hot gas flow 358. This is in contrast to the typical buildup of hot gases at the secondary combustor liner which can occur in the absence of such impingement jets, as shown at 400. In both FIGS. 9 and 10, and as hereinbefore described, the impingement jets are provided with pressurized cooling air from the compressor of the gas turbine, which travels through the combustor on the outside of the inner liner.

In an embodiment, a combustor is provided. The combustor includes a combustor shell, an inner liner disposed inside the combustor shell and having an inner surface configured to receive hot combustion gases from a combustion chamber of the combustor, and an outer surface, the combustor shell and the inner liner defining an annular flow channel therebetween, and a segment carrier operatively connected to the inner liner and operative to receive an upper portion of the inner liner, the segment carrier and the inner liner defining a purging cavity therebetween. The inner liner includes a plurality of impingement jet holes configured to direct a flow of cooling air from the annular flow channel to the purging cavity. In an embodiment, the combustor may include a retaining ring coupled to the segment carrier and being configured to protect at least a portion of the segment carrier from the hot combustion gases. In an embodiment, the impingement jet holes are configured to direct the flow of cooling air to impinge on the retaining ring to provide impingement cooling of the retaining ring. In an embodiment, the inner liner includes a conical portion, and the impingement jet holes are formed in the conical portion of the inner liner. In an embodiment, the impingement jet holes are located approximately every 1.8° throughout the conical portion of the inner liner. In an embodiment, the impingement jet holes may be located approximately every 1° to 2.6° throughout the conical portion of the inner liner. In an embodiment, the annular flow channel is configured to receive the cooling air from a compressor stage of a gas turbine. In an embodiment, the combustor is a silo combustor. In an embodiment, the retaining ring is formed from steel. In an embodiment, the combustor may also include a plurality of segments carried on an inner periphery of the segment carrier, the segments and the segment carrier defining a segmented zone of a hot gas passage of the combustor.

In another embodiment, a gas turbine system is provided. The gas turbine system includes a compressor and a combustor downstream from the compressor. The combustor includes a combustor shell, and an inner liner disposed inside the combustor shell and having an inner surface configured to receive hot combustion gases from a combustion chamber of the combustor, and an outer surface. The combustor shell and the inner liner define an annular flow channel therebetween. The combustor further includes a segment carrier arranged generally above the inner liner and receiving an upper portion of the inner liner, the segment carrier and the inner liner defining a purging cavity therebetween, and a plurality of impingement jet holes formed in the inner liner and providing a flow passage between the annular flow channel and the purging cavity. The compressor is configured to supply compressed air to the annular flow channel. A first portion of the compressed air is used by the combustor for combustion, producing the hot combustion gases, and a second portion of the compressed air is directed through the impingement jet holes to the purging cavity to purge the purging cavity of the hot combustion gases. In an embodiment, the combustor further includes a retaining ring coupled to the segment carrier, the retaining ring being configured to protect at least a portion of the segment carrier from the hot combustion gases, wherein the impingement jet holes are configured to direct the second portion of the compressed air to impinge on the retaining ring to provide impingement cooling of the retaining ring. In an embodiment, the inner liner includes a conical portion, and the impingement jet holes are formed in the conical portion of the inner liner. In an embodiment, the impingement jet holes are located approximately every 1.8° throughout a circumference of the conical portion of the inner liner. In an embodiment, the impingement jet holes are located approximately every 1° to 2.6° throughout a circumference of the conical portion of the inner liner. In an embodiment, the combustor is a silo combustor. In an embodiment, the retaining ring is formed from steel.

In yet another embodiment, a method of cooling a component in a gas turbine system is provided. The method includes the steps of passing compressed air into an annular channel defined between an outer surface of an inner liner of a combustor of a gas turbine system and one of a middle liner and an outer shell of the combustor, the inner liner being configured to receive a flow of hot combustion gas from a combustion zone of the combustor therethrough, and passing a portion of the compressed air in the annular channel through a plurality of impingement jet holes in the inner liner such that the compressed air impinges on a component exposed to the flow of hot combustion gas to provide for impingement cooling of the component. In an embodiment, the component is a retaining ring of the combustor, the retaining ring shielding a segment carrier of the combustor from the flow of hot combustion gas. In an embodiment, the segment carrier receives an upper portion of the inner liner, the segment carrier and the inner liner defining a purging cavity therebetween, wherein the impingement jet holes direct the portion of the compressed air into the purging cavity to clear the purging cavity of the hot combustion gas.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A combustor, comprising:

a combustor shell defining an outer liner;

an inner liner disposed inside the combustor shell and having an inner surface defining a cavity configured to receive hot combustion gases from a combustion chamber of the combustor, and an outer surface, the combustor shell and the inner liner defining an annular flow channel therebetween; and a segment carrier operatively connected to the inner liner and operative to receive an upper portion of the inner liner, the segment carrier and the inner liner defining a purging cavity therebetween;

wherein the inner liner includes a plurality of impingement jet holes configured to direct a flow of cooling air from the annular flow channel to the purging cavity.

2. The combustor of claim 1, further comprising:

a retaining ring coupled to the segment carrier and being configured to protect at least a portion of the segment carrier from the hot combustion gases.

3. The combustor of claim 2, wherein:

the plurality of impingement jet holes are configured to direct the flow of cooling air to impinge on the retaining ring to provide impingement cooling of the retaining ring.

4. The combustor of claim 3, wherein:

the inner liner includes a conical portion; and the plurality of impingement jet holes are formed in the conical portion of the inner liner.

5. The combustor of claim 4, wherein:

the plurality of impingement jet holes are located approximately every 1.8° throughout the conical portion of the inner liner.

6. The combustor of claim 5, wherein:

the annular flow channel is configured to receive the cooling air from a compressor stage of a gas turbine.

7. The combustor of claim 5, wherein:

the combustor is a silo combustor.

8. The combustor of claim 4, wherein:

the plurality of impingement jet holes are located approximately every 1° to 2.6° throughout the conical portion of the inner liner.

9. The combustor of claim 5, wherein:

the retaining ring is formed from steel.

10. The combustor of claim 5, further comprising:

a plurality of segments carried on an inner periphery of the segment carrier, the plurality of segments and the segment carrier defining a segmented zone of a hot gas passage of the combustor.

11. A gas turbine system, comprising:

a compressor; and a combustor downstream from the compressor and including:

a combustor shell defining an outer liner;

an inner liner disposed inside the combustor shell and having an inner surface defining a cavity configured to receive hot combustion gases from a combustion chamber of the combustor, and an outer surface, the combustor shell and the inner liner defining an annular flow channel therebetween;

a segment carrier operatively connected to the inner liner and operative to receive an upper portion of the inner liner, the segment carrier and the inner liner defining a purging cavity therebetween; and a plurality of impingement jet holes formed in the inner liner and providing a flow passage between the annular flow channel and the purging cavity;

wherein the compressor is configured to supply compressed air to the annular flow channel;

wherein a first portion of the compressed air is used by the combustor for combustion, producing the hot combustion gases; and wherein a second portion of the compressed air is directed through the plurality of impingement jet holes to the purging cavity to purge the purging cavity of the hot combustion gases.

12. The gas turbine system of claim 11, wherein:

the combustor further includes a retaining ring coupled to the segment carrier, the retaining ring being configured to protect at least a portion of the segment carrier from the hot combustion gases;

wherein the plurality of impingement jet holes are configured to direct the second portion of the compressed air to impinge on the retaining ring to provide impingement cooling of the retaining ring.

13. The gas turbine system of claim 12, wherein:

the inner liner includes a conical portion; and the plurality of impingement jet holes are formed in the conical portion of the inner liner.

14. The gas turbine system of claim 13, wherein:

the plurality of impingement jet holes are located approximately every 1.8° throughout a circumference of the conical portion of the inner liner.

15. The gas turbine system of claim 14, wherein:

the combustor is a silo combustor.

16. The gas turbine system of claim 14, wherein:

the retaining ring is formed from steel.

17. The gas turbine system of claim 13, wherein:

the plurality of impingement jet holes are located approximately every 1° to 2.6° throughout a circumference of the conical portion of the inner liner.

18. A method of cooling a component in a gas turbine system, comprising the steps of:

passing compressed air into an annular channel defined between an outer surface of an inner liner of a combustor of a gas turbine system and one of a middle liner and an outer shell of the combustor, the inner liner being configured to receive a flow of hot combustion gas from a combustion zone of the combustor there through;

passing a portion of the compressed air in the annular channel through a plurality of impingement jet holes in the inner liner such that the compressed air impinges on a component exposed to the flow of hot combustion gas to provide for impingement cooling of the component; and wherein:

the component is a retaining ring of the combustor, the retaining ring shielding a segment carrier of the combustor from the flow of hot combustion gas.

19. The method according to claim 18, wherein:

the segment carrier receives an upper portion of the inner liner, the segment carrier and the inner liner defining a purging cavity therebetween;

wherein the plurality of impingement jet holes direct the portion of the compressed air into the purging cavity to clear the purging cavity of the hot combustion gas.

* * * * *